US011161529B2

(12) United States Patent
Clavier

(10) Patent No.: US 11,161,529 B2
(45) Date of Patent: Nov. 2, 2021

(54) RAILWAY VEHICLE AND ASSOCIATED TRAFFIC METHOD

(71) Applicant: ALSTOM Transport Technologies, Saint-Ouen (FR)

(72) Inventor: Jérémy Clavier, Le Creusot (FR)

(73) Assignee: ALSTROM TRANSPORT TECHNOLOGIES, Saint-Ouen (FR)

( * ) Notice: Subject to any disclaimer, the term of this patent is extended or adjusted under 35 U.S.C. 154(b) by 315 days.

(21) Appl. No.: 16/385,856

(22) Filed: Apr. 16, 2019

(65) Prior Publication Data

US 2019/0315380 A1 Oct. 17, 2019

(30) Foreign Application Priority Data

Apr. 17, 2018 (FR) ..... 18 53346

(51) Int. Cl.
*B61F 5/14* (2006.01)
*B61F 5/10* (2006.01)

(52) U.S. Cl.
CPC ..... *B61F 5/144* (2013.01); *B61F 5/10* (2013.01)

(58) Field of Classification Search
CPC ..... B61F 5/10; B61F 5/144
See application file for complete search history.

(56) References Cited

U.S. PATENT DOCUMENTS 5,682,980 A * 11/1997 Reybrouck ..... B60G 17/04 280/124.16
5,769,400 A * 6/1998 Holzl ..... B60G 17/0152 105/199.2
6,637,348 B1 * 10/2003 Teichmann ..... B60G 17/0272 105/199.1
2004/0016361 A1 * 1/2004 Teichmann ..... B61D 47/00 105/164
2019/0315380 A1 * 10/2019 Clavier ..... B61F 5/144
2019/0315381 A1 * 10/2019 Clavier ..... B61F 1/14

FOREIGN PATENT DOCUMENTS

| | | | |
|---|---|---|---|
| EP | 0663877 | A1 | 7/1995 |
| EP | 0663877 | B1 | 5/1996 |
| GB | 2310024 | A | 8/1997 |
| WO | 94/08833 | A1 | 4/1994 |

OTHER PUBLICATIONS

FR Search Report, dated Jan. 9, 2019, from corresponding FR application No. 18 53346.

* cited by examiner

*Primary Examiner* — Jason C Smith
(74) *Attorney, Agent, or Firm* — Nixon & Vanderhye

(57) ABSTRACT

Disclosed is a railway vehicle with a car and a bogie. The bogie includes a chassis and a secondary suspension system. The secondary suspension system includes a jack and a power supply device of the jack fluidly connected to the jack by at least one flow limiter. The jack is configured to go from a first so-called passive configuration, in which the supply device is inactive, the jack then being able to passively damp the oscillations between the car and the chassis using the flow limiter, to a second so-called active configuration in which the supply device is configured to supply the jack in order to modify the distance between the car and the chassis or in order to keep the distance constant between the car and the chassis.

11 Claims, 4 Drawing Sheets

RAILWAY VEHICLE AND ASSOCIATED TRAFFIC METHOD

FIELD

The present invention relates to a railway vehicle comprising at least one car and at least one bogie carrying the car, the bogie comprising a chassis and a secondary suspension system between the chassis and the car, the secondary suspension system comprising a jack comprising two ends extending along a same axis and a supply system of the jack.

BACKGROUND

In order to facilitate the embarking and disembarking of persons and/or goods, it is advantageous to be able to adjust the height of the car, in order to adapt it to that of the platform when the railway vehicle is at a station.

Document US 2004/0016361 describes a rail vehicle comprising a car, a bogie and a suspension system comprising a suspension spring and a jack in parallel extending between the car and the bogie. The jack makes it possible to vary the distance between the bogie and the car, the height of the car thus being variable. This in particular makes it possible to reduce the vertical distance between the floor of the car and a platform.

However, this system is not fully satisfactory. Indeed, when the railway vehicle is in motion, the jack is not supplied and does not participate in the damping between the car and the bogie. The presence of the jack mechanically connecting the car and the bogie increases the stiffness of the system, thus deteriorating the vertical damping of the overall suspension system between the car and the bogie.

SUMMARY OF THE INVENTION

The invention in particular aims to resolve these drawbacks by proposing a railway vehicle comprising a suspension system having improved damping during the movement phases of the railway vehicle.

The invention also aims to incorporate the damping function into the suspension system.

To that end, the invention in particular relates to a railway vehicle of the aforementioned type, wherein the jack is fluidly connected to the supply device by at least one flow limiter, and wherein the jack is configured to go from a first so-called passive configuration, in which the supply device is inactive, the jack then being able to passively damp the oscillations in an elevation direction between the car and the chassis using the flow limiter, to a second so-called active configuration in which the supply device is configured to supply the jack in order to modify the distance between the car and the chassis or in order to keep the distance constant between the car and the chassis.

The jack is thus able to bring the car and the chassis to, then keep them at, a constant distance, for example chosen so that the height from the floor of the car when stopped at a station is substantially equal to the height of the platform of that station. When the railway vehicle is in motion between two stations, the jack participates in the damping between the car and the chassis owing to the flow limiter.

A railway vehicle according to the invention may further include one or more of the following features, considered alone or according to all technically possible combinations.

- the railway vehicle further comprises a set of springs mounted between the car and the chassis;
- the first end of the jack is connected to the car by a knuckle joint-type connection and the second end of the jack is connected to the chassis by a knuckle joint-type connection;
- the jack comprises at least one cylinder and a piston separating the cylinder into an upper chamber and a lower chamber, the power supply device of the jack being configured to power the upper and lower chambers;
- the power supply device comprises at least one accumulator able to store pressurized fluid and a pressure discharge reservoir;
- the upper chamber of the jack is connected to the power supply device by a so-called "3-way/2-position" valve, the "3-way/2-position" valve having an inlet connected to the upper chamber of the jack, a first outlet connected to the reservoir and a second outlet connected to the accumulator, the "3-way/2-position" valve connecting the inlet to the first outlet in a first position of the "3-way/2-position" valve or to the second outlet in a second position of the "3-way/2-position" valve;
- the jack is connected to the power supply device by a so-called "4-way/3-position" valve, the "4-way/3-position" valve having a first inlet connected to the upper chamber of the jack, a second inlet connected to the lower chamber of the jack, a first outlet connected to the reservoir and a second outlet connected to the accumulator, the "4-way/3-position" valve connecting:
- the first inlet to the first outlet and the second inlet to the second outlet in a first position of the "4-way/3-position" valve,
- the first inlet and the second inlet to the second outlet in a second position of the "4-way/3-position" valve, or
- the first inlet to the second outlet and the second inlet to the first outlet in a third position of the "4-way/3-position" valve;
- the jack comprises a position detector able to determine the position of the piston in the cylinder, the position detector being a magnetic sensor, a laser sensor or an ultrasound sensor;
- the jack further comprises a damping device, the damping device connecting the jack and the chassis, the damping device being able to damp the oscillations in the elevation direction between the jack and the chassis.

The invention also relates to a traffic method of a rail vehicle as previously defined, comprising the following steps:

- travel of the railway vehicle, the jack being in the passive configuration and damping the oscillations in the elevation direction between the jack and the chassis.
- stopping of the railway vehicle at a platform, the jack being in the active configuration and powered by the power supply device, so as to change the distance between the car and the chassis or to keep the distance between the chassis and the car constant.

BRIEF DESCRIPTION OF THE DRAWINGS

The invention will be better understood using the following description, provided solely as an example and done in reference to the appended figures, in which.

DETAILED DESCRIPTION

The terms "vertical" and "horizontal" are to be understood generally relative to the typical directions of a rail vehicle running on horizontal rails.

Figure 1:
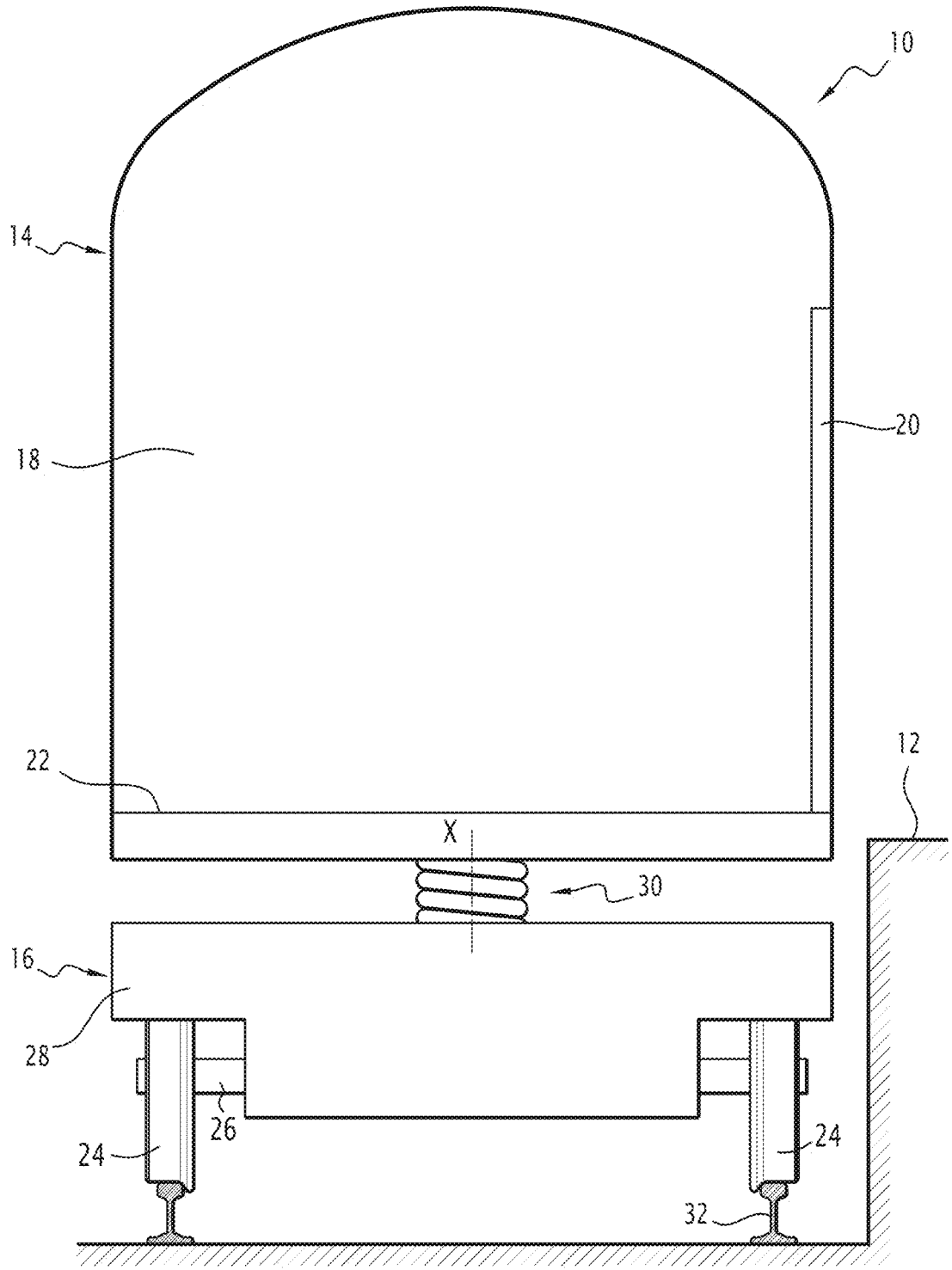
FIG. 1 is a schematic sectional view of a railway vehicle according to the invention, stopped at a station.

A rail vehicle 10 stopped at a station is shown in FIG. 1.

The station comprises at least one platform 12, such that the rail vehicle 10 is stopped along the platform 12.

The rail vehicle 10 comprises at least one car 14, at least one bogie 16 carrying the car 14.

The car 14 has an inner volume 18 configured to receive passengers and/or goods to be transported. The inner volume 18 communicates with the outside via at least one door 20. The inner volume 18 is in particular defined by a lower floor 22, on which the passengers and/or goods move.

The bogie 16 for example extends at one end of the car 14 and supports two adjacent cars 14 when the railway vehicle 10 comprises several cars 14. According to one conventional embodiment, the or each car 14 is supported by two bogies 16 at each of its ends.

The bogie 16 comprises wheels 24 mounted rotating on the bogie 16 by axles 26, a chassis 28 and a secondary suspension system 30 arranged between the chassis 28 and the car 14.

The wheels 24 are configured to roll on rails 32 and thus to allow the movement of the railway vehicle 10.

In one advantageous embodiment, the bogie 16 comprises four secondary suspension systems 30, located in the four corners of the bogie 16, the bogie 16 having a substantially rectangular cross-section. The term "transverse" is defined generally relative to a direction substantially orthogonal to the movement direction of the railway vehicle 10 and to an elevation direction, for example substantially vertical when the railway vehicle 10 moves on horizontal rails 32. The terms "lower" and "upper" are defined relative to the elevation direction.

The secondary suspension system 30 extends along a main axis X extending along the elevation direction.

The secondary suspension system 30 makes it possible to react the movements along the elevation direction between the car 14 and the bogie 16. The secondary suspension system 30 in particular makes it possible to perform both the suspension function between the car 14 and the bogie 16 and the positioning function along the elevation direction of the car 14 relative to the train station platform 12.

Figure 2:
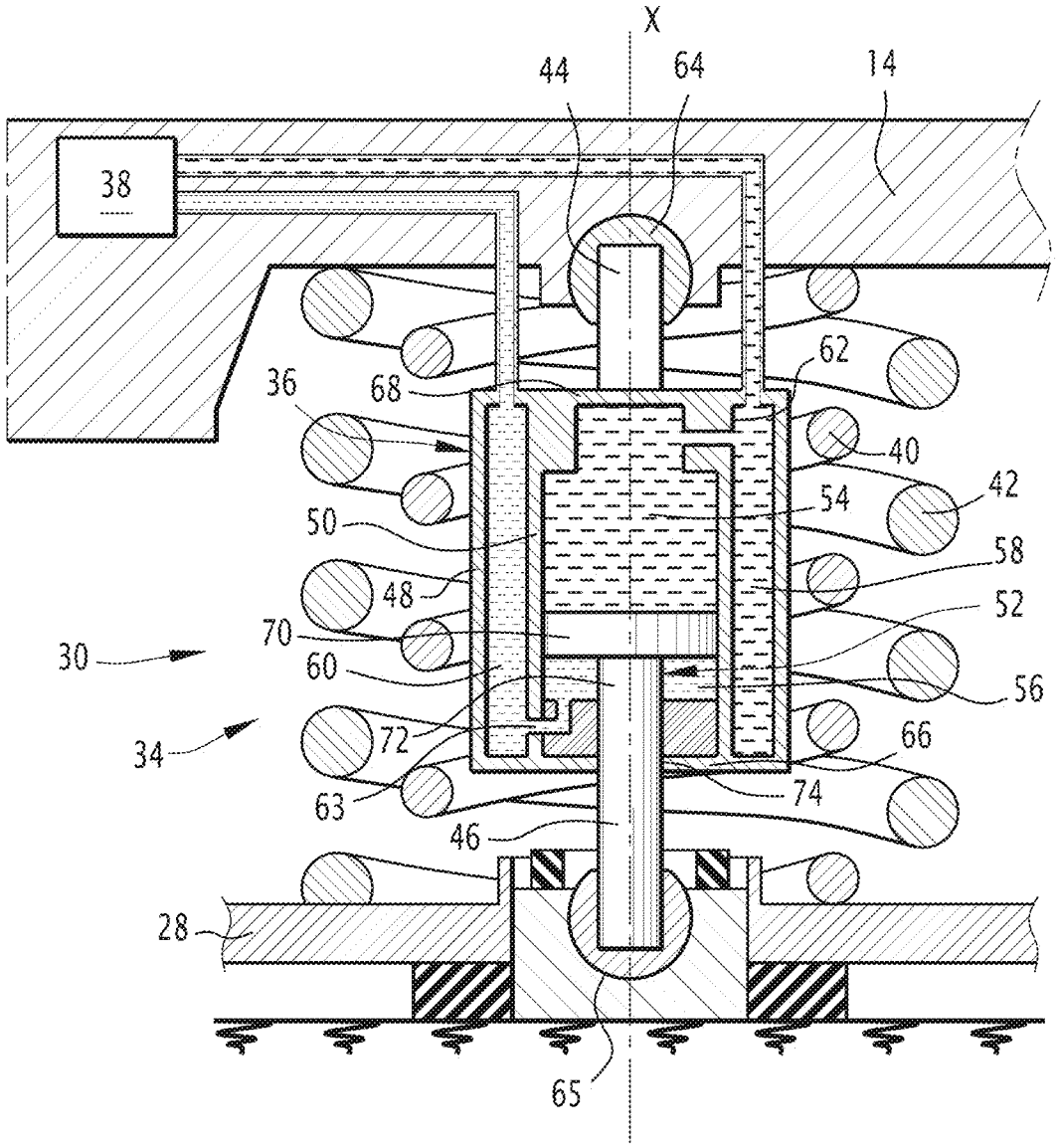
FIG. 2 is a schematic sectional view, along a vertical plane, of a first secondary suspension system of a railway vehicle according to the invention.
Figure 3:
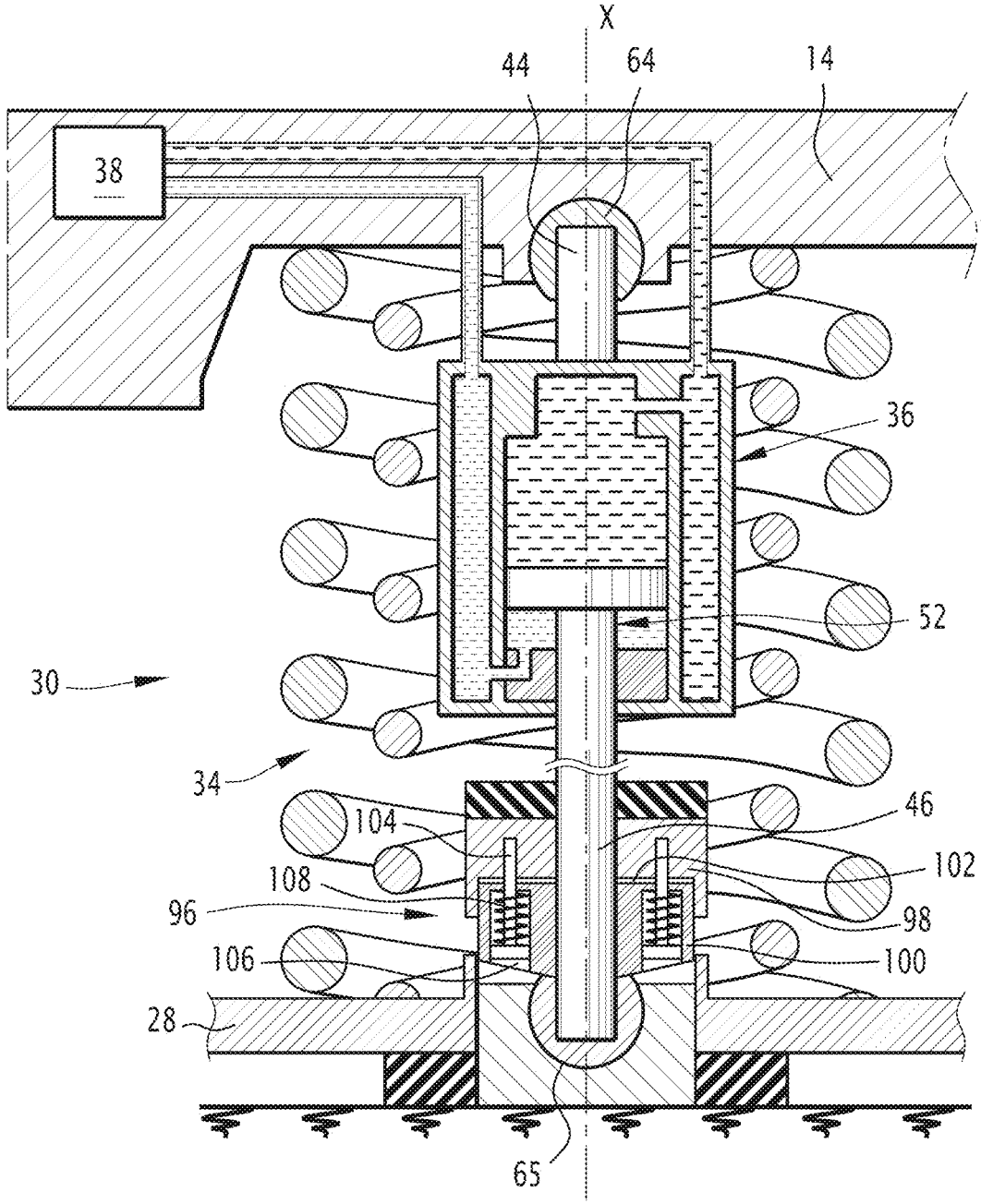
FIG. 3 is a schematic sectional view, along a vertical plane, of a second secondary suspension system of a railway vehicle according to the invention.

To that end, the secondary suspension system 30, shown in FIGS. 2 and 3, comprises a spring assembly 34 mounted between the chassis 28 and the car 14, a jack 36 and a power supply device 38 of the jack 36.

According to the embodiment shown in FIGS. 2 and 3, the spring assembly 34 comprises at least an inner spring 40 and an outer spring 42.

The inner spring 40 and the outer spring 42 are helical and coaxial springs, having the main axis X as central axis.

They each extend between the chassis 28 and the car 14. They are further secured to the chassis 28 and the car 14.

The diameter of the inner spring 40 is smaller than the diameter of the outer spring 42, such that the inner spring 40 extends in the inner volume defined by the outer spring 42.

Advantageously, the inner spring 40 and the outer spring 42 wind around the jack 36.

The inner spring 40 and the outer spring 42 for example have opposite winding directions.

The spring assembly 34 allows a relative movement in the elevation direction between the chassis 28 and the car 14.

The jack 36 performs a positioning function of the car 14 relative to the bogie 16 in the elevation direction.

The jack 36 is able to go from a first so-called passive configuration, in which the power supply device 38 is inactive, the jack then being able to passively damp the oscillations in the elevation direction between the car 14 and the chassis 28, to a second so-called active configuration, in which the power supply device 38 is configured to supply the jack 26 in order to modify the distance between the car 14 and the chassis 28 or in order to keep the distance constant between the car 14 and the chassis 28.

The jack 36 extends along the main axis X. The jack 36 comprises a first end 44 and a second end 46 that are substantially aligned along the main axis X. The jack 36 further comprises an outer cylinder 48, an inner cylinder 50 and a piston 52 placed in the inner cylinder 50 and separating the inner cylinder 50 into an upper chamber 54 and a lower chamber 56.

The diameter of the outer cylinder 48 is substantially greater than the diameter of the inner cylinder 50. The inner cylinder 50 is situated in the inner volume defined by the outer cylinder 48.

The jack 36 comprises two channels 58, 60 located outside the inner cylinder 50. Advantageously, the two channels 58, 60 are located in the volume defined between the outer cylinder 48 and the inner cylinder 50.

The first channel 58 communicates fluidly with the upper chamber 54 by a first passage orifice 62. The second channel 60 communicates fluidly with the lower chamber 56 by a second passage orifice 63.

The first end 44 of the jack 36 is mechanically connected to the car 14. In one advantageous embodiment, the connection between the first end 44 and the car 14 is a first knuckle joint 64 allowing the jack 36 to be rotatable in all directions around the first knuckle joint 64 relative to the car 14.

The second end 46 of the jack 36 is mechanically connected to the chassis 28. In one advantageous embodiment, the connection between the second end 46 and the chassis 28 is a second knuckle joint 65 allowing the jack 36 to be rotatable in all directions around the second knuckle joint 65 relative to the chassis 28.

The first and second knuckle joints 64, 65 allow the jack 36 to follow the relative movements of the bogie 16 and the car 14 in the transverse and longitudinal directions, corresponding to the travel direction of the railway vehicle 10, during the movement of the railway vehicle 10. Thus, the jack 36 does not undergo transverse forces, due to the relative movements of the bogie 16 and the car 14, these transverse forces being able to damage the jack 36. Furthermore, the jack 36 substantially does not add additional stiffness to the secondary suspension system 30.

The first end 44 and the second end 46 are located outside the outer cylinder 48, the outer cylinder 48 being located between the first end 44 and the second end 46 along the main axis X.

The inner cylinder 50 extends along the main axis X between a lower part 66 and an upper part 68.

The piston 52 is movable in the inner cylinder 50 and comprises a head 70 and a rod 72 secured to the head 70.

The head 70 is able to slide in the inner cylinder 50 along the main axis X, between the lower part 66 and the upper part 68.

The head 70 separates the inner cylinder 50 into two chambers hermetically separated from one another, i.e., the upper chamber 54 and the lower chamber 56.

The rod 72 hermetically passes through the lower part 66 of the cylinder 48 along the main axis X at a third passage orifice 74. The rod 72 comprises the second end 46. The second end 46 is located opposite the head 70 relative to the main axis X.

The jack 36 advantageously comprises a position detector 75 able to determine the position of the piston 52 in the inner cylinder 50.

The position detector 75 is for example a magnetic sensor, a laser sensor or an ultrasound sensor.

The power supply device 38 is able to supply the jack 36 with fluid, for example oil, here at a pressure comprised between 50 bars and 150 bars.

The power supply device 38 is configured to control the movement of the piston 52 in the inner cylinder 50, when the jack 36 is in the active configuration.

The power supply device 38 is in particular configured to control the movement of the piston 52 by supplying the upper 54 and lower 56 chambers in order to increase or decrease the volume thereof.

Figure 4:
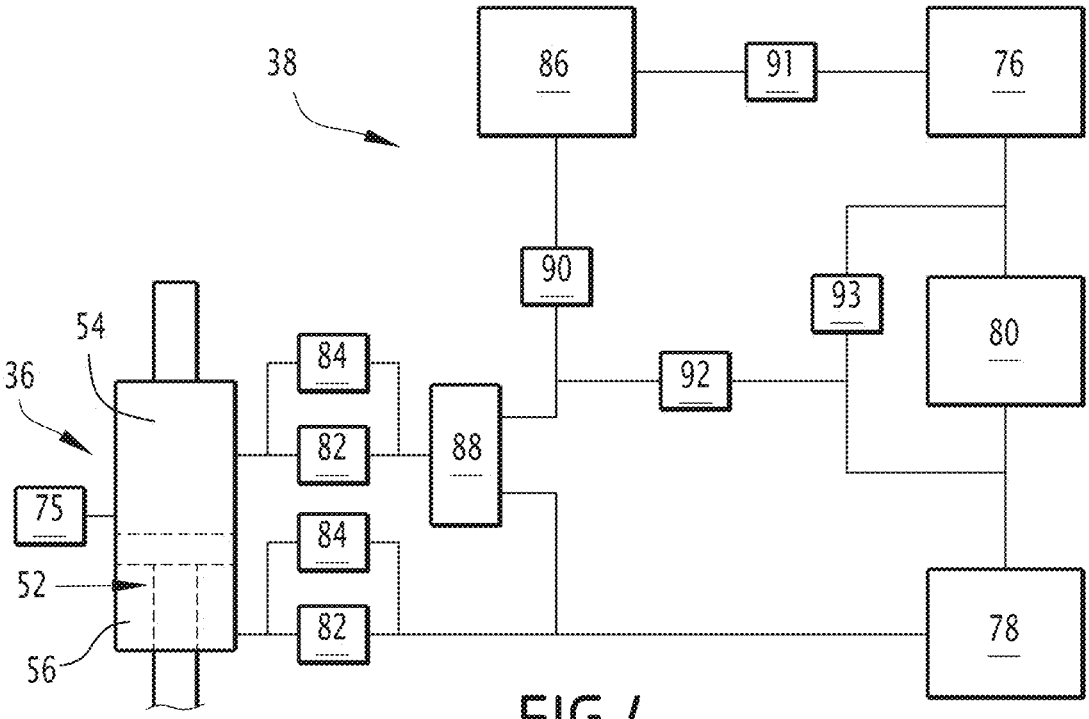
FIG. 4 is a schematic diagram of a first power supply system of a jack of a railway vehicle according to the invention.

As illustrated in FIG. 4, the supply device 38 comprises a main accumulator 76, a reservoir 78, a pump 80, at least one flow limiter 82.

The main accumulator 76 is able to store pressurized fluid. For example, the main accumulator 76 is able to store 2 L of fluid at a pressure of up to 150 bars.

The reservoir 78 is able to store fluid, for example up to 5 L of oil.

The main accumulator 76 and the reservoir 78 are fluidly connected. The main accumulator 76 is able to discharge its pressure toward the reservoir 78 by transferring fluid from the main accumulator 76 to the reservoir 78.

The pump 80 is configured to circulate the fluid from the reservoir 78 to the main accumulator 76 in order to pressurize the main accumulator 76. The pump 80 advantageously has a maximum power substantially equal to 1500 W so as to be able to circulate the fluid efficiently.

The power supply device 38 is connected to the jack 36 by at least one flow limiter 82. In one advantageous embodiment, the power supply device 38 comprises two flow limiters 82, each respectively connected to the upper chamber 54 and the lower chamber 56 of the jack 36.

Each flow limiter 82 is configured to create a head loss upon passage of a fluid through the flow limiter 82.

A flow limiter 82 is for example a valve having a smaller fluid passage section relative to the rest of the pipes of the supply device 38. Thus, upon passing through the flow limiter 82, the passing fluid flow is decreased and a fluid head loss is created.

The flow limiter 82 can therefore be considered an obstacle for the fluid, thus acting similarly to a shock absorber.

Advantageously, each flow limiter 82 is mounted in parallel with a nonreturn valve 84. Each nonreturn valve 84 is configured to allow the fluid to circulate only from the power supply device 38 toward the jack 36, without head loss. The nonreturn valve 84 thus prevents the circulation of the fluid from the jack 36 toward the power supply device 38.

The flow limiter 82 and the nonreturn valve 84 being placed in parallel, a fluid circulating from the power supply device 38 toward the jack 36 preferably circulates through the nonreturn valve 84 and a fluid circulating from the jack 36 toward the power supply device 38 circulates through the flow limiter 82.

In one advantageous embodiment comprising several jacks 36, for example four as previously described, each jack 36 is connected to a power supply device 38. The different power supply devices 38 are fluidly connected to one another. The power supply circuit thus obtained advantageously comprises a single main accumulator 76, a single pump 80 and a single reservoir 78 in order to optimize the cost of the power supply circuit.

In one advantageous embodiment, the or each power supply device 38 also comprises a secondary accumulator 86, a valve, called "3-way/2-position" valve, or more simply "3/2" valve 88, and at least one control valve 90.

The secondary accumulator 86 is able to store pressurized fluid. For example, the secondary accumulator 86 is able to store 0.5 L of fluid at a pressure of up to 150 bars.

The secondary accumulator 86 is fluidly connected to the main accumulator 76.

The main accumulator 76 is configured to circulate fluid toward the secondary accumulator 78 in order to pressurize it.

The "3/2" valve 88 comprises an inlet connected to the upper chamber 54 of the jack 36, a first outlet connected to the reservoir 78 and a second outlet connected to the secondary accumulator 86.

The "3/2" valve 88 is configured to connect the inlet with the first outlet in a first "3/2" valve 88 position and to connect the inlet with the second outlet in a second position of the "3/2" valve 88.

Each control valve 90 is able to allow the fluid to circulate through said control valve 90 in a first so-called open position and to prevent the fluid from circulating through said control valve 90 in a second so-called closed position.

In one advantageous embodiment, the supply system comprises at least four control valves 90, 91, 92, 93 respectively located between the "3/2" valve 88 and the secondary accumulator 86, between the secondary accumulator 86 and the main accumulator 76, between the "3/2" valve 88 and the reservoir 76 and in parallel with the pump 80.

The operation of the secondary suspension system 30, and in particular of the power supply device 38, will now be described in detail, using the description of a first traffic method of the railway vehicle 10. It should be noted that the operation is identical for all of the secondary suspension systems 30 of the railway vehicle 10.

In a first step, the railway vehicle 10 circulates on the rails 32 outside a train station or a station comprising a platform 12.

The jack 36 is in the passive configuration and the power supply device 38 is inactive.

The pump 80 is stopped.

The main accumulator 76 and the secondary accumulator 86 are not pressurized.

The valves 90, 91, 92, 93 are open and allow the fluid to circulate.

The "3/2" valve 88 is in the first position connecting the upper chamber 54 of the jack 36 to the reservoir 78.

The upper 54 and lower 56 chambers are thus connected to the reservoir 78. The fluid is free to enter and leave the upper 54 and lower 56 chambers of the jack 36.

Upon leaving the upper 54 and lower 56 chambers, the fluid passes through the flow limiter 82, the flow limiter 82 creating a head loss opposing the circulation of the fluid through the flow limiter 82. The flow limiter 82 therefore acts as a damper for the oscillations of the piston 52 in the inner cylinder 50.

In the passive configuration, the jack 36 therefore passively damps the oscillations in the elevation direction between the car 14 and the chassis 28 using the flow limiters 82.

In a second step, the railway vehicle 10 is approaching the depot or station.

In other words, the railway vehicle 10 is at a distance for example of less than 30 m from the depot or station.

The pump 80 is started.

The valve 90 is closed in order to isolate the secondary accumulator 86 from the jack 36.

The valve 93 is closed so that the pump 80 circulates fluid from the reservoir 78 toward the main accumulator 76.

Thus, the main accumulator 76 and the secondary accumulator 86 are pressurized.

The pressure in the main accumulator 76 and the secondary accumulator 86 is regulated to reach the desired pressure by alternatively closing or opening the valves 91 and 93.

The jack 36 is still in the passive configuration and passively damps the oscillations in the elevation direction between the car 14 and the chassis 28 using the flow limiters 82.

Then, in a third step, the rail vehicle 10 stops at the station along a platform 12.

The height of the lower floor 22 is lower than the height of the platform 12 due to the mass of the car 14 and of the passengers and/or goods present in the inner volume 18.

The "3/2" valve 88 enters its second position connecting the upper chamber 54 of the jack 36 to the secondary accumulator 86.

The valve 90 is opened in order to fluidly connect the upper chamber 54 of the jack 36 to the secondary accumulator 86.

The valve 91 is opened in order to fluidly connect the secondary accumulator 86 and the main accumulator 76.

The valves 92 and 93 are closed.

Due to the pressure contained in the secondary accumulator 86 and in the main accumulator 76, the upper chamber 54 of the jack 36 increases in volume and moves the piston 52 in a direction in which the piston 52 moves away from the car 14.

The jack 36 is then in the active position.

The position of the piston 52 in the jack 36 is regulated owing to the position detector 75 and by alternatively closing or opening the valves 91, 92 and 93.

Thus, the jack 36 moves the car 14 away from the chassis 28 until reaching a predetermined distance between the car 14 and the chassis 28. The predetermined distance between the car 14 and the chassis 28 is for example such that the height from the ground of the floor 22 of the car 14 is substantially equal to the height from the ground of the platform 12, i.e., the floor 22 and the platform 12 extend in a same horizontal plane.

The valves 90, 91 and 92 are then closed in order to keep the piston 52 in a constant position and therefore to keep the floor 22 and the platform 12 at a same height.

The valve 93 is closed to return the main accumulator 76 to the desired pressure, then the valve 93 is opened so that the pump 80 causes the fluid to circulate only through the valve 93 and no longer toward the main valve 76.

The jack 36 is therefore powered by the power supply device 38, so as to keep the distance between the chassis 28 and the car 14 constant and prevent the free movement of the set of springs 34.

The door 20 is then opened and the passengers and/or goods located in the inner volume 18 can then easily leave or be removed from the railway vehicle 10 through the door 20 in order to be found on the platform 12. Conversely, passengers and/or goods initially located on the platform 12 can enter or be placed in the inner volume 18.

When all of the passengers and/or goods have left and/or entered the inner volume 18, the door 20 is closed again.

In a fourth step, the valve 90 is closed in order to isolate the upper chamber 52 of the secondary accumulator 86.

The fluid leaves the upper chamber 54 of the jack 36 and is discharged into the reservoir 78 by passing through the valve 92.

When the pressure in the upper chamber 54 is low, for example less than 10 bars, the "3/2" valve 88 enters the first position connecting the upper chamber 54 directly to the reservoir 78.

Thus, the piston 52 moves in a direction in which the piston 52 comes closer to the car 14. The distance between the car 14 and the chassis 28 decreases until reaching an equilibrium position between the pressure of the upper 54 and lower 56 chambers.

The pump 80 is stopped.

The valves 90, 91, 92 and 93 are opened.

The jack 36 then returns to the passive position.

Lastly, in a fifth step, the railway vehicle 10 starts again from the station and the set of springs 34 and the jack 36 passively damp the oscillations in an elevation direction between the car 14 and the chassis 28.

Figure 5:
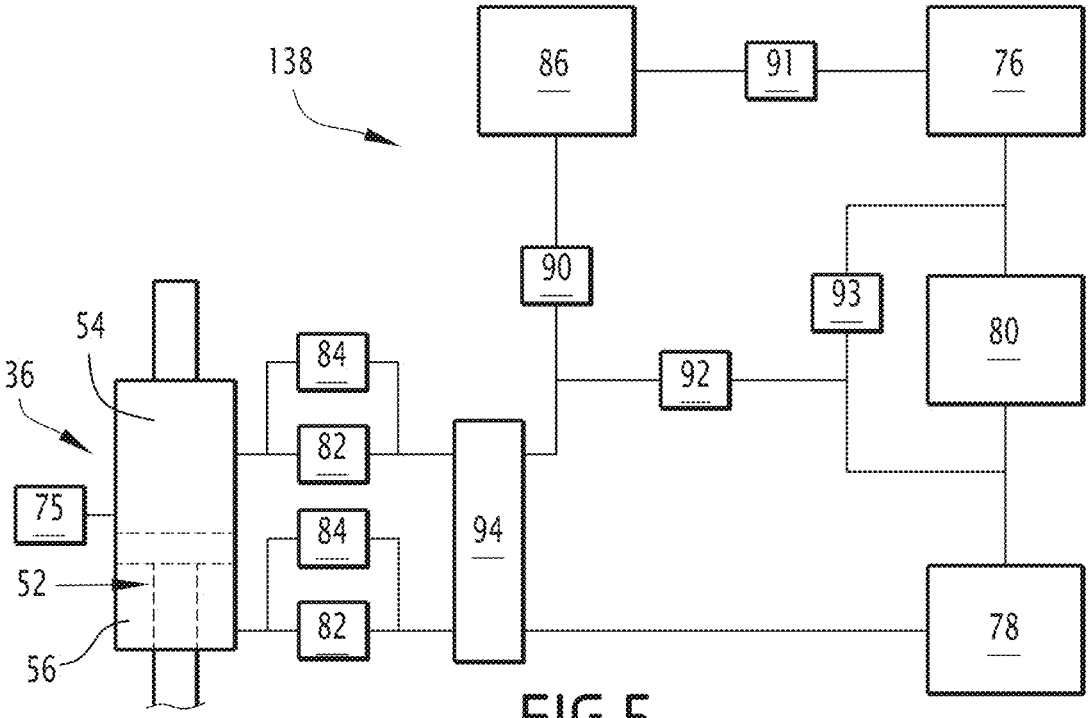
FIG. 5 is a schematic diagram of a second power supply system of a jack of a railway vehicle according to the invention.

A second embodiment of the invention is shown in FIG. 5 and will be described below. In the second embodiment of the invention, a second power supply device 138, different from the power supply device 38 described above, is used.

Hereinafter, only the differences between the power supply device 138 according to the second embodiment and the power supply device 38 according to the first embodiment will be described, and the similar elements will not be described again and will bear the same references.

The second power supply device 138 is generally similar to the power supply device 38 and simply differs in that it comprises a valve, called "4-way/3-position" valve or more simply "4/3" valve 94, in place of the "3/2" valve 88.

The "4/3" valve 94 comprises an inlet connected to the upper chamber 54 of the jack 56, a first outlet connected to the reservoir 78 and a second outlet connected to the secondary accumulator 86.

The "4/3" valve 94 is configured to connect the first inlet with the first outlet and the second inlet with the second outlet in a first position of the "4/3" valve 94, to connect the first inlet and the second inlet with the second outlet in a second position of the "4/3" valve 94 and to connect the first inlet with the second outlet and the second inlet with the first outlet in a third position of the "4/3" valve 94.

The first two positions of the "4/3" valve 94 are identical to the two positions of the "3/2" valve 88.

The third position makes it possible to connect the accumulator 86 to the lower chamber 56 and thus to increase the volume of the lower chamber 56 of the jack 36 in order to bring the car 14 and the chassis 28 closer together.

A second traffic method of the railway vehicle 10 comprising the power supply device 138 according to the second embodiment will now be described.

The second traffic method differs from the first traffic method in that during the fourth step, the "4/3" valve 94 enters the third position connecting the lower chamber 56 to the secondary accumulator 86 and the upper chamber 54 to the reservoir 78.

The valve 90 is opened so that the secondary accumulator 86 pressurizes the lower chamber 56. The lower chamber 56 increases in volume and thus drives the movement of the piston 52 toward the car 14.

The distance between the car 14 and the chassis 28 therefore decreases in a controlled manner owing to the position detector 75, the pressure in the lower chamber 56 being able to be regulated by alternatively opening and closing the valve 90.

A third embodiment of the invention is shown in FIG. 3 and will be described below.

In the third embodiment of the invention, the jack 36 further comprises a damping device 96.

The damping device 96 is located between the second end 46 of the jack 36 and the second knuckle joint 65.

The damping device 96 comprises two parts 98 and 100.

The first part 98 is connected to the second end 46 of the jack 36 and the second part 100 is connected to the second knuckle joint 65.

The first part 98 defines a cavity 102 in which the second part 100 can be inserted.

The first part 98 and the second part 100 are connected at least by a rod 104.

The first end of the rod 104 is fastened on the first part 98.

The second end of the rod 104 is free to slide in a channel 106 defined by the second part 100.

The damping device 96 comprises at least one return spring 108 placed in the channel 106 and connected to the second end of the rod 104.

The return spring 108 constrains the insertion of the second part 100 in the first part 98.

Thus, the damping device 96 is configured to go from a first idle configuration in which the second part 100 is inserted in the first part 98, the return spring 108 being idle, to a second damping configuration in which the first part 98 and the second part 100 have a clearance, the return spring 108 being compressed.

The damping device 96 is therefore configured to react part of the oscillations in an elevation direction between the car 14 and the chassis 28 in order to decrease the mechanical stresses on the jack 36 and thus extend its lifetime.

The embodiments described above may be combined to create new embodiments.

The invention claimed is:

1. A railway vehicle comprising at least one car and at least one bogie carrying the car, the bogie comprising a chassis and a secondary suspension system between the chassis and the car, the secondary suspension system, comprising:

a jack comprising two ends extending along a same axis; and a power supply system of the jack;

wherein the jack is fluidly connected to the power supply device (38) by at least one flow limiter, and wherein the jack is configured to go from a first so-called passive configuration, in which the supply device is inactive, the jack then being able to passively damp the oscillations in an elevation direction between the car and the chassis using the flow limiter, to a second so-called active configuration in which the supply device is configured to supply the jack in order to modify the distance between the car and the chassis or in order to keep the distance constant between the car and the chassis.

2. The railway vehicle according to claim 1, further comprising a set of springs mounted between the car and the chassis.

3. The railway vehicle according to claim 1, wherein the first end of the jack is connected to the car by a knuckle joint-type connection and the second end of the jack is connected to the chassis by a knuckle joint-type connection.

4. The railway vehicle according to claim 1, wherein the jack comprises at least one cylinder and a piston separating the cylinder into an upper chamber and a lower chamber, the power supply device of the jack being configured to power the upper and lower chambers.

5. The railway vehicle according to claim 4, wherein the power supply device comprises at least one accumulator able to store pressurized fluid and a pressure discharge reservoir.

6. The railway vehicle according to claim 5, wherein the upper chamber of the jack is connected to the power supply device by a so-called "3-way/2-position" valve, the "3-way/2-position" valve having an inlet connected to the upper chamber of the jack, a first outlet connected to the reservoir and a second outlet connected to the accumulator, the "3-way/2-position" valve connecting the inlet to the first outlet in a first position of the "3-way/2-position" valve or to the second outlet in a second position of the "3-way/2-position" valve.

7. The railway vehicle according to claim 5, wherein the jack is connected to the power supply device by a so-called "4-way/3-position" valve, the "4-way/3-position" valve having a first inlet connected to the upper chamber of the jack, a second inlet connected to the lower chamber of the jack, a first outlet connected to the reservoir and a second outlet connected to the accumulator, the "4-way/3-position" valve connecting:

the first inlet to the first outlet and the second inlet to the second outlet in a first position of the "4-way/3-position" valve, the first inlet and the second inlet to the second outlet in a second position of the "4-way/3-position" valve, or the first inlet to the second outlet and the second inlet to the first outlet in a third position of the "4-way/3-position" valve.

8. The railway vehicle according to claim 4, wherein the jack comprises a position detector able to determine the position of the piston in the cylinder, the position detector being a magnetic sensor, a laser sensor or an ultrasound sensor.

9. The railway vehicle according to claim 1, wherein the jack further comprises a damping device, the damping device connecting the jack and the chassis, the damping device being able to damp the oscillations in the elevation direction between the jack and the chassis.

10. A traffic method of a railway vehicle according to claim 1, comprising the following steps:

travel of the railway vehicle, the jack being in the passive configuration and damping the oscillations in the elevation direction between the jack and the chassis, stopping of the railway vehicle at a platform, the jack being in the active configuration and powered by the power supply device, so as to change the distance between the car and the chassis or to keep the distance between the chassis and the car constant.

11. A railway vehicle comprising at least one car and at least one bogie carrying the car, the bogie comprising a chassis and a secondary suspension system between the chassis and the car, the secondary suspension system, comprising:

a jack comprising two ends extending along a same axis; and a power supply system of the jack;

wherein the jack is fluidly connected to the power supply device (38) by at least one flow limiter, wherein the jack is configured to go from a first so-called passive configuration, in which the supply device is inactive, the jack then being able to passively damp the oscillations in an elevation direction between the car and the chassis using the flow limiter, to a second so-called active configuration in which the supply device is configured to supply the jack in order to modify the distance between the car and the chassis or in order to keep the distance constant between the car and the chassis, wherein the jack comprises at least one cylinder and a piston separating the cylinder into an upper chamber and a lower chamber, the power supply device of the jack being configured to power the upper and lower chambers, wherein the power supply device comprises at least one accumulator able to store pressurized fluid and a pressure discharge reservoir, wherein the upper chamber of the jack is connected to the power supply device by a so-called "3-way/2-position" valve, the "3-way/2-position" valve having an inlet connected to the upper chamber of the jack, a first outlet connected to the reservoir and a second outlet connected to the accumulator, the "3-way/2-position" valve connecting the inlet to the first outlet in a first position of the "3-way/2-position" valve or to the second outlet in a second position of the "3-way/2-position" valve, or the jack is connected to the power supply device by a so-called "4-way/3-position" valve, the "4-way/3-position" valve having a first inlet connected to the upper chamber of the jack, a second inlet connected to the lower chamber of the jack, a first outlet connected to the reservoir and a second outlet connected to the accumulator, the "4-way/3-position" valve connecting:

the first inlet to the first outlet and the second inlet to the second outlet in a first position of the "4-way/3-position" valve, the first inlet and the second inlet to the second outlet in a second position of the "4-way/3-position" valve, or the first inlet to the second outlet and the second inlet to the first outlet in a third position of the "4-way/3-position" valve.

* * * * *